US008242394B2

(12) United States Patent
Mueller et al.

(10) Patent No.: US 8,242,394 B2
(45) Date of Patent: Aug. 14, 2012

(54) STATIONARY CONTACT ASSEMBLY INCLUDING FIRST AND SECOND STATIONARY CONTACTS, AND CIRCUIT INTERRUPTER AND TRANSFER SWITCH EMPLOYING THE SAME

(75) Inventors: Robert W. Mueller, Aliquippa, PA (US); James W. Krieger, Pittsburgh, PA (US); Paul A. Merck, Crescent, PA (US); Amelia M. Stay, Monaca, PA (US); Cathleen M. Clausen, Arden, NC (US); Joshua D. Myers, Fletcher, NC (US)

(73) Assignee: Eaton Corporation, Cleveland, OH (US)

( * ) Notice: Subject to any disclaimer, the term of this patent is extended or adjusted under 35 U.S.C. 154(b) by 435 days.

(21) Appl. No.: 12/704,651

(22) Filed: Feb. 12, 2010

(65) Prior Publication Data

US 2011/0198203 A1 Aug. 18, 2011

(51) Int. Cl.
*H01H 1/02* (2006.01)

(52) U.S. Cl. ..... 200/268; 439/668

(58) Field of Classification Search ..... 200/268, 200/269, 262, 400; 439/886, 887
See application file for complete search history.

(56) References Cited

U.S. PATENT DOCUMENTS

| | | | | |
|---|---|---|---|---|
| 3,191,275 | A * | 6/1965 | Gwyn, Jr. | 200/267 |
| 4,747,061 | A | 5/1988 | Lagree et al. | |
| 4,894,796 | A | 1/1990 | Engel et al. | |
| 5,210,685 | A | 5/1993 | Rosa | |
| 5,304,753 | A | 4/1994 | Parrish et al. | |
| 5,397,868 | A | 3/1995 | Smith et al. | |
| 5,876,862 | A * | 3/1999 | Shibuya et al. | 200/268 |
| 6,459,054 | B1 | 10/2002 | Rowe et al. | |
| 6,614,334 | B1 | 9/2003 | Gibson et al. | |
| 6,686,547 | B2 * | 2/2004 | Kern et al. | 200/268 |
| 6,714,108 | B1 | 3/2004 | Simms et al. | |
| 6,747,534 | B1 * | 6/2004 | Mueller et al. | 335/38 |
| 6,849,967 | B2 | 2/2005 | Lathrop et al. | |
| 7,163,753 | B2 * | 1/2007 | Ota et al. | 439/886 |
| 7,239,045 | B2 | 7/2007 | Lathrop et al. | |
| 7,368,677 | B2 | 5/2008 | Jones et al. | |
| 7,569,949 | B2 | 8/2009 | Lathrop et al. | |
| 2002/0050447 | A1 | 5/2002 | Nishikawa | |
| 2004/0036562 | A1 | 2/2004 | Siebels et al. | |
| 2006/0113170 | A1 | 6/2006 | Rochon et al. | |

* cited by examiner

*Primary Examiner* — Felix O Figueroa
(74) *Attorney, Agent, or Firm* — Eckert Seamans Cherin & Mellott, LLC; Kirk D. Houser

(57) ABSTRACT

A circuit interrupter includes a movable contact assembly having a movable contact, a stationary contact assembly, and an operating mechanism. The stationary contact assembly includes a conductor, a first stationary contact disposed on the conductor, and a second stationary contact disposed on the same such conductor proximate the first stationary contact. The first stationary contact has a first contact surface disposed a first distance from the conductor. The second stationary contact has a second contact surface disposed a second distance from the conductor. The second distance is smaller than the first distance. The operating mechanism is structured to move the movable contact assembly and cause the movable contact to engage or disengage from at least the first contact surface of the first stationary contact.

17 Claims, 4 Drawing Sheets

STATIONARY CONTACT ASSEMBLY INCLUDING FIRST AND SECOND STATIONARY CONTACTS, AND CIRCUIT INTERRUPTER AND TRANSFER SWITCH EMPLOYING THE SAME

BACKGROUND

1. Field

The disclosed concept pertains generally to separable contacts and, more particularly, to stationary contact assemblies. The disclosed concept also pertains to circuit interrupters including a stationary contact assembly. The disclosed concept also pertains to transfer switches including stationary contact assemblies.

2. Background Information

Transfer switches are well known in the art. See, for example, U.S. Pat. Nos. 7,569,949; 7,239,045; 6,849,967; 5,397,868; 5,210,685; 4,894,796; and 4,747,061. Transfer switches operate, for example, to transfer a power consuming load from a circuit with a normal power supply to a circuit with an auxiliary power supply. Applications for transfer switches include stand-by applications, among others, in which the auxiliary power supply stands-by if the normal power supply should fail. Facilities having a critical requirement for continuous electric power, such as hospitals, certain plant processes, computer installations, and the like, have a standby power source, often a diesel generator. A transfer switch can control electrical connection of utility power lines and the diesel generator to facility load buses. In many installations, the transfer switch automatically starts the standby generator and connects it to the load bus upon loss of utility power, and reconnects the utility power to the load bus if utility power is reestablished.

A transfer switch typically can comprise a pair of circuit interrupters combined with a drive input and a linkage system. The preferred types of circuit interrupters have been molded-case switches and molded-case circuit breakers because these types are commercially available in a wide array of sizes and are relatively economical compared to other options. The preferred type of drive input depends on the application for the transfer switch. Usually motors or solenoids are preferred, but at other times there is a clear preference for manually-operated mechanisms.

A typical automatic transfer switch (ATS) includes a housing, an operating mechanism, a first line bus, a second line bus, a load bus, a first line movable contact, a second line movable contact, a fixed contact assembly, and a control device. The operating mechanism, first line movable contact, second line movable contact, fixed contact assembly, and control device are disposed within the housing. Only one of the first and second movable contacts engages the fixed contact assembly at a time. That is, in the normal operating configuration, the first movable contact is in a second position, and is capable of providing electricity to a system load from a primary power source, and the second movable contact is in a first position. If the need arises, the first movable contact is moved into the first position while the second movable contact moves into the second position. The transfer can occur almost instantaneously. In this configuration, a secondary power source is capable of providing electricity to the system load. Operation (i.e., positioning of the first and second movable contacts) is performed by the operating mechanism.

It is known for circuit breakers to include a set of main contacts, an operating mechanism for opening the set of main contacts, a trip device to actuate the operating mechanism to trip the set of main contacts open in response to certain overcurrent conditions, a set of secondary contacts, and a remotely controllable actuator to control the open and closed states of the set of secondary contacts.

A known circuit breaker includes line and load terminals, and first and second circuit breaker mechanisms. Each of the first and second circuit breaker mechanisms includes a corresponding set of separable contacts in series between circuit breaker line and load terminals, a corresponding operating mechanism for moving the corresponding set of separable contacts between open and closed positions, and a corresponding trip mechanism cooperating with the corresponding operating mechanism for moving the corresponding set of separable contacts from the closed to the open position thereof.

U.S. Pat. No. 7,368,677 discloses a circuit breaker pole including a pair of main contacts that include a stationary main contact and a movable main contact. The movable main contact is carried by a moving conductor assembly. This moving conductor assembly includes a plurality of contact fingers, which are mounted in spaced axial relation on a pivot pin secured in a contact carrier. The contact carrier is rotated about pivots by an operating mechanism. A movable main contact is fixed to each of the contact fingers at a point spaced from the free end of the finger. The portion of the contact finger adjacent the free end forms a moving arcing contact or "arc toe". A stationary arcing contact is provided on the confronting face of an integral arcing contact and runner mounted on a line side conductor. The stationary arcing contact and arc toe together form a pair of arcing contacts.

Automatic transfer switch power contactors preferably provide extensive endurance life. Typically, the stationary contacts thereof have superior anti-welding and temperature profiles.

There is room for improvement in stationary contact assemblies.

There is also room for improvement in a circuit interrupter employing a stationary contact assembly.

There is further room for improvement in a transfer switch employing stationary contact assemblies.

SUMMARY

These needs and others are met by embodiments of the disclosed concept, which provide a first stationary contact disposed on a conductor, and a second stationary contact disposed on the same such conductor proximate the first stationary contact. The first stationary contact has a first contact surface disposed a first distance from the conductor, and the second stationary contact has a second contact surface disposed a second smaller distance from the conductor.

In accordance with one aspect of the disclosed concept, a stationary contact assembly comprises: a conductor; a first stationary contact disposed on the conductor; and a second stationary contact disposed on the same such conductor proximate the first stationary contact, wherein the first stationary contact has a first contact surface disposed a first distance from the conductor, wherein the second stationary contact has a second contact surface disposed a second distance from the conductor, and wherein the second distance is smaller than the first distance.

The first contact surface of the first stationary contact may be subject to wear such that the first distance is subject to being reduced to about the second distance; and after the wear, both of the first and second stationary contacts may be structured to be engaged by a movable contact.

The first stationary contact may be structured to resist arcing better than the second stationary contact; and the second stationary contact may be structured to be more durable than the first stationary contact.

The second stationary contact may be structured to cooperate with the first stationary contact in order to extend the endurance life of the stationary contact assembly.

The first stationary contact may include a first side and an opposite second side; the conductor may be a conductive mounting block; an arc runner may be disposed on the conductive mounting block adjacent the first side of the first stationary contact; and the second stationary contact may be disposed on the conductive mounting block adjacent the opposite second side of the first stationary contact.

As another aspect of the disclosed concept, a circuit interrupter comprises: a movable contact assembly comprising a movable contact; a stationary contact assembly comprising: a conductor, a first stationary contact disposed on the conductor, and a second stationary contact disposed on the same such conductor proximate the first stationary contact, wherein the first stationary contact has a first contact surface disposed a first distance from the conductor, wherein the second stationary contact has a second contact surface disposed a second distance from the conductor, and wherein the second distance is smaller than the first distance; and an operating mechanism structured to move the movable contact assembly and cause the movable contact to engage or disengage from at least the first contact surface of the first stationary contact.

As another aspect of the disclosed concept, a transfer switch comprises: two movable contact assemblies, each of the two movable contact assemblies comprising a movable contact; two stationary contact assemblies, each of the two stationary contact assemblies comprising: a conductor; a first stationary contact disposed on the conductor, and a second stationary contact disposed on the same such conductor proximate the first stationary contact, wherein the first stationary contact has a first contact surface disposed a first distance from the conductor, wherein the second stationary contact has a second contact surface disposed a second distance from the conductor, and wherein the second distance is smaller than the first distance; and an operating mechanism structured to move the two movable contact assemblies and cause the movable contact of a corresponding one of the two movable contact assemblies to either engage or disengage from at least the first contact surface of the first stationary contact of a corresponding one of the two stationary contact assemblies.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" means one or an integer greater than one (i.e., a plurality).

As employed herein, the term "coupled" means to directly or indirectly link, join or connect two or more elements.

As employed herein, the term "directly coupled" means that two elements are directly in contact with or directly connected to each other.

As employed herein, the term "stationary" means the same as the term "fixed".

As employed herein and with reference to electrical components, the term "engage" means temporarily coupled and allowing for electrical communication.

As employed herein, the term "proximate" means adjacent with or without contact, immediately adjacent, adjoining, contiguous, directly abutting, or flush.

Generally, an automatic transfer switch is in an operating configuration wherein power from a primary power source can pass through the automatic transfer switch. Accordingly, most "first" positions disclosed herein correspond to this operating configuration. When the automatic transfer switch is in another operating configuration wherein power from a secondary power source can pass through the automatic transfer switch, most components are in "second" positions as disclosed herein. The exception to this convention is the position of first and second movable contacts. In order to have the description of the positions of such first and second movable contacts be consistent with each other, the first and second movable contacts are in their "first position" when the corresponding circuit is open (i.e., the movable contact does not engage a number of corresponding stationary contacts). Similarly, when either one of the first and second movable contacts is in its "second position," the movable contact engages a number of corresponding stationary contacts. Thus, in a normal operating configuration, most components are in the "first position," however, the first movable contact is in the "second position" (i.e., closed with power capable of flowing therethrough).

The disclosed concept is described in association with an automatic transfer switch having a single phase, although the disclosed concept is applicable to a wide range of transfer switches or circuit interrupters having any number of phases or poles, and to stationary contact assemblies for those and other electrical switching apparatus.

Figure 1:
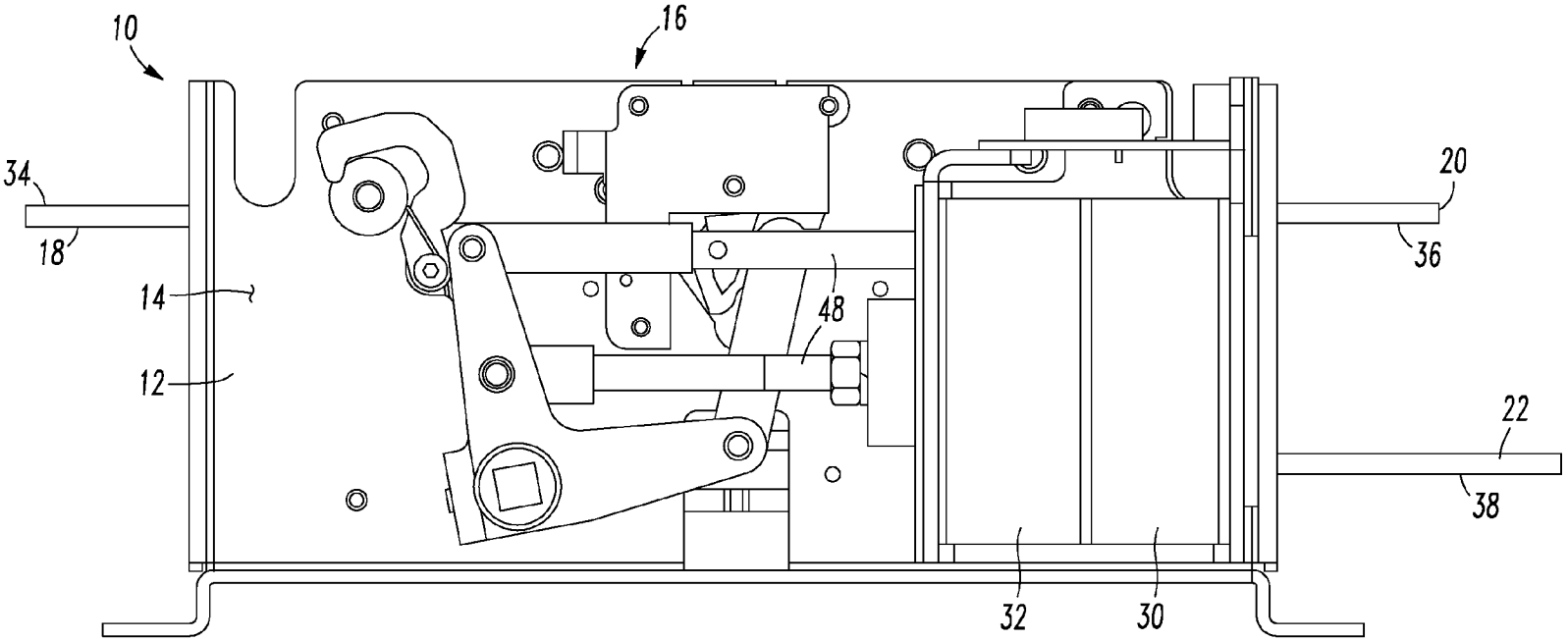
FIG. 1 is a cross-sectional side view of a portion of an automatic transfer switch with an operating mechanism in a first position in accordance with embodiments of the disclosed concept.
Figure 2:
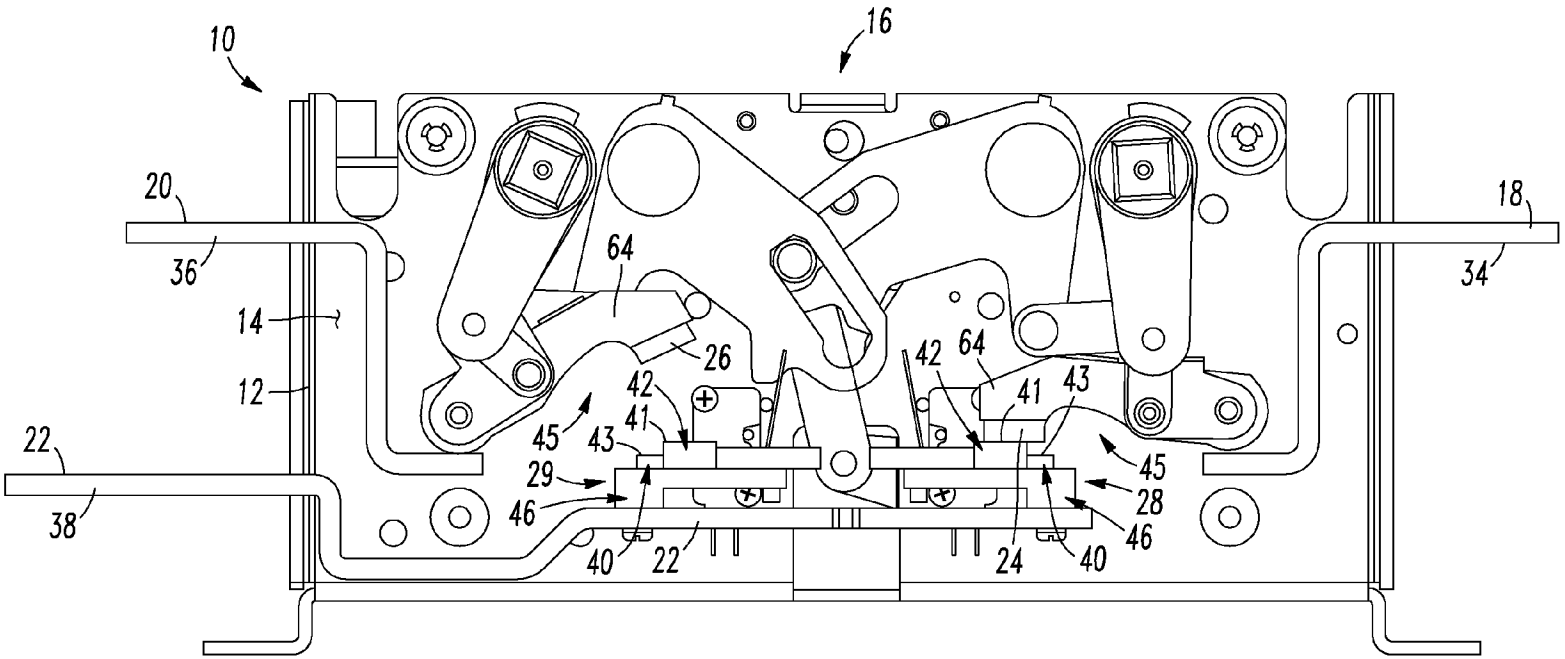
FIG. 2 is a cross-sectional side view of another portion of the automatic transfer switch of FIG. 1 with the operating mechanism in the first position, a first movable contact in its second position, and a second movable contact in its first position.

Referring to FIGS. 1 and 2, a transfer switch 10 includes two movable contact assemblies 45, each of which includes a corresponding movable contact 24 or 26. The transfer switch 10 also includes two stationary contact assemblies 28,29.

Figure 3:
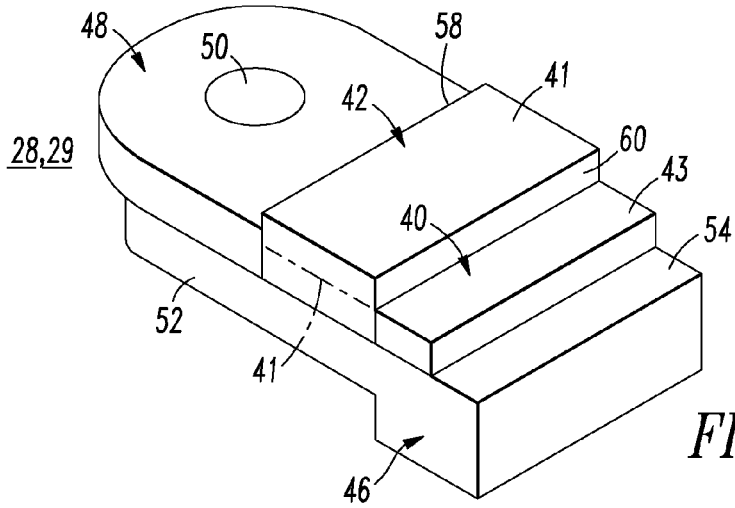
FIG. 3 is an isometric view of one of the stationary contact assemblies of FIG. 1.

As shown in FIG. 3, each of the two stationary contact assemblies 28,29 includes a conductor 46, a first (or primary) stationary contact 42 disposed on the conductor 46, and a second (or secondary) stationary contact 40 disposed on the same such conductor 46 proximate the first stationary contact 42. The first stationary contact 42 has a first contact surface 41 disposed a first distance 47 from the conductor 46. The second stationary contact 40 has a second contact surface 43 disposed a second distance 49 from the conductor 46. The second distance 49 is smaller than the first distance 47.

Referring again to FIGS. 1 and 2, an operating mechanism 16 is structured to move the two movable contact assemblies 45 and cause the movable contact 24,26 of a corresponding one of the two movable contact assemblies 45 to either engage or disengage from at least the first contact surface 41 of the first stationary contact 42 of a corresponding one of the two stationary contact assemblies 28,29.

Example 1

As shown in FIGS. 1 and 2, the example transfer switch 10 is an automatic transfer switch (ATS) 10 including a housing 12 (shown in part) that defines an enclosed space 14, the operating mechanism 16, a first line bus 18, a second line bus 20, a load bus 22, a first line movable contact 24 (hereinafter "first movable contact"), a second line movable contact 26 (hereinafter "second movable contact"), the two stationary contact assemblies 28,29, and a control device 30 having an actuator 32. The operating mechanism 16, first movable contact 24, second movable contact 26, stationary contact assemblies 28,29, and control device 30 are disposed within the housing enclosed space 14. The first line bus 18 is substantially disposed within the housing enclosed space 14, but includes a terminal 34 that extends outside the housing 12. The first line bus terminal 34 can be coupled to, and be in electrical communication with, a primary or normal power or utility source (not shown). Similarly, the second line bus 20 is substantially disposed within the housing enclosed space 14, but includes a terminal 36 that extends outside the housing 12. The second line bus terminal 36 can be coupled to, and be in electrical communication with, a secondary or backup or auxiliary power source (not shown). The load bus 22 also is disposed, substantially, within the housing enclosed space 14 and includes a terminal 38 that extends outside the housing 12. The load bus terminal 38 is coupled to, and in electrical communication with, a system load (not shown). The stationary contact assemblies 28,29 are coupled to, and in electrical communication with, the load bus 22. The stationary contact assemblies 28,29 are structured to be engaged, respectively, by the first movable contact 24 (as shown in FIG. 2) and the second movable contact 26 (shown open in FIG. 2).

The first movable contact 24 is coupled to, and in electrical communication with, the first line bus 18. The coupling between the first movable contact 24 and the first line bus 18 may be through a conductor, such as, but not limited to a copper wire or a flexible conductor (not shown), but is preferably a direct, but movable, coupling as shown in FIG. 2. The first movable contact 24 is structured to move between a first position (not shown, but see the first position of the second movable contact 26), wherein the first movable contact 24 does not engage the stationary contact assembly 28, and a second position (as shown in FIG. 2), wherein the first movable contact 24 engages, and is in electrical communication with, the stationary contact assembly 28.

Similarly, the second movable contact 26 is coupled to, and in electrical communication with, the second line bus 20. The second movable contact 26 is structured to move between a first position (as shown in FIG. 2), wherein the second movable contact 26 does not engage the stationary contact assembly 29, and a second position (not shown, but see the second position of the first movable contact 24), wherein the second movable contact 26 engages, and is in electrical communication with, the stationary contact assembly 29.

Only one of the first and second movable contacts 24,26 engages at least the corresponding first stationary contact 42 (as shown in FIG. 2) of the two respective stationary contact assemblies 28,29 at one time (as shown in FIG. 2, movable contact 24 is closed and movable contact 26 is open). That is, in the normal operating configuration, the first movable contact 24 is in the second position, thereby being capable of providing electricity to the system load (not shown) from the primary or normal or utility power source (not shown), and the second movable contact 26 is in the first position. As the ATS 10 typically operates in this configuration, the operating mechanism 16 in this configuration may also be identified as a "stationary condition". If the need arises, the first movable contact 24 is moved into the first position, while the second movable contact 26 moves into the second position. In this configuration, the secondary or backup or auxiliary power source (not shown) is capable of providing electricity to the system load (not shown).

The configuration/position of the operating mechanism 16 is controlled by the actuator 32. The actuator 32, which typically includes a solenoid (not shown) or other suitable actuating device, is structured to receive a command signal from a user (not shown). Upon receiving a command signal, the actuator 32 is actuated and, via at least one actuator link 48 (two example actuator links 48 are shown in FIG. 1), causes the operating mechanism 16 to separate the engaged movable contact 24 from the stationary contact assembly 28 and engage the other movable contact 26 with the other stationary contact assembly 29. Because the operating mechanism 16 is designed and intended to operate at the speed caused by actuation of the at least one actuator link 48, this motion is identified as the "standard motion condition".

Operation (i.e., positioning of the first and second movable contacts 24,26) is performed by the operating mechanism 16. That is, the operating mechanism 16 is structured to move the first movable contact 24 and the second movable contact 26 between their respective first and second positions. The operating mechanism 16 may be described, generally, as being in a first position, or configuration, when the first movable contact 24 is in the second (closed) position, while the second movable contact 26 is in the first (open) position, and, the operating mechanism 16 is in a second position, or configuration, when the first movable contact 24 is in the first (open) position, while the second movable contact 26 is in the second (closed) position. The operating mechanism 16 is preferably configured by a plurality of mechanical linkages (not numbered) to ensure that both the first and second movable contacts 24,26 are not in the second (closed) position at the same time. Both the first and second movable contacts 24,26 may, however, be in the first (open) position at the same time (i.e., the system load (not shown) would not be receiving power through the ATS 10). The operating mechanism 16 includes one or more springs (not shown) structured to maintain the engaged movable contact 24 or 26 in the second (closed) position.

A non-limiting example of the ATS 10, but excluding the disclosed stationary contact assemblies 28,29, is disclosed by U.S. patent application Ser. No. 12/466,780, filed May 15, 2009, entitled "Inertial Catch For An Automatic Transfer Switch Power Contactor", which is incorporated by reference herein.

Example 2

Figure 4:
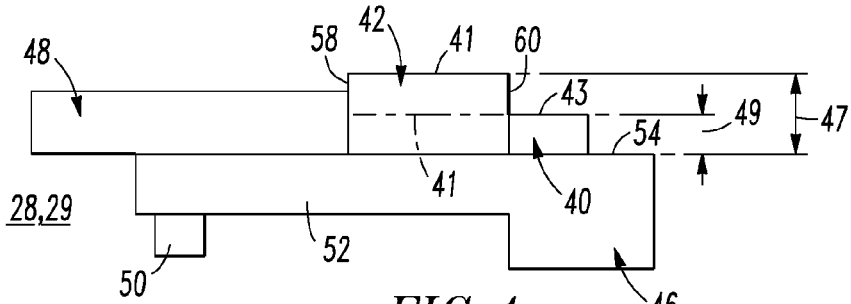
FIG. 4 is a vertical elevation view of the stationary contact assembly of FIG. 3.
Figure 5:
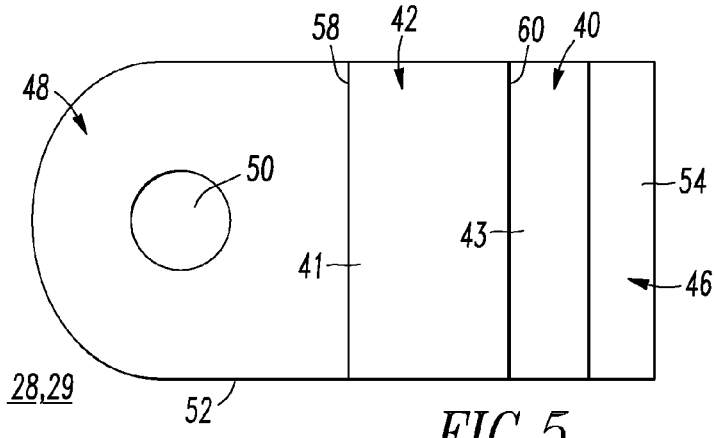
FIG. 5 is a plan view of the stationary contact assembly of FIG. 3.

As shown in FIGS. 3-5, the first stationary contact 42 can include a first side 58 and an opposite second side 60. An arc runner 48 is disposed on a conductor, such as the example conductive mounting block 46, adjacent the first side 58 of the first stationary contact 42. The second stationary contact 40 is disposed on the conductive mounting block 46 adjacent the opposite second side 60 of the first stationary contact 42.

As shown in FIG. 2, the conductor 46 of one of the two stationary contact assemblies 28,29 is coupled to the conductor 46 of the other one of the two stationary contact assemblies 28,29 by load bus 22. The conductors 46 and the load bus 22 are structured to power a load (not shown).

Example 3

The first stationary contact 42 has a relatively high silver content and the second stationary contact 40 has a relatively lower silver content. In this manner, the first stationary contact 42 is relatively more conductive than the second stationary contact 40.

The first stationary contact 42 can be made, for example and without limitation, from 97% silver and 3% carbon.

The second stationary contact 40 can be made, for example and without limitation, from 50% silver and 50% tungsten.

The arc runner 48 and a spin rivet 50 can be made, for example and without limitation, from steel.

Example 4

The example 50% silver-50% tungsten second stationary contact 40 is structured for durability. The example 97% silver-3% carbon first stationary contact 42 is structured for arcing and for operation at relatively lower temperatures. The example second stationary contact 40 is meant to help the example first stationary contact 42 at the end of the endurance life.

Example 5

The example first stationary contact 42 is preferably flush with the arc runner 48. The arc runner 48, and the first and second stationary contacts 42,40 are preferably flush with side surface 52 of the mounting block 46.

Example 6

The arc runner 48, and the first and second stationary contacts 42,40 are directly coupled (e.g., without limitation, brazed) to top surface 54 of the mounting block 46.

Example 7

The spin rivet 50 ensures that there is no relative movement between the arc runner 48 and the mounting block 46.

Example 8

One of the two movable contact assemblies 45 is structured to receive a first power source (not shown). The other one of the two movable contact assemblies 45 is structured to receive a second power source (not shown). The conductor 46 of one of the two stationary contact assemblies 28,29 is electrically connected by load bus 22 to the conductor 46 of the other one of the two stationary contact assemblies 28,29. The conductors 46 and the load bus 22 are structured to power a load (not shown).

Example 9

The movable contact assembly 45 carries the corresponding movable contact 24 or 26. The movable contact assembly 45, over time, causes the corresponding movable contact 24 or 26 to wear the first contact surface 41 (as shown in phantom line drawing in FIG. 4) of the corresponding first stationary contact 42 until the corresponding movable contact 24 or 26 engages both of the corresponding first and second contact surfaces 41,43.

Example 10

The second stationary contact 40 is structured to cooperate with the first stationary contact 42 in order to extend the endurance life of the transfer switch 10.

Example 11

The second stationary contact 40 is disposed on the conductor 46 adjacent the first stationary contact 42.

Example 12

The first contact surface 41 of the first stationary contact 42 can be subject to wear such that the first distance 47 is subject to being reduced to about the second distance 49. After such wear, both of the first and second stationary contacts 42,40 can be structured to be engaged by the corresponding movable contact 24,26.

Example 13

The first stationary contact 42 can be structured to resist arcing better than the second stationary contact 40, which can be structured to be more durable than the first stationary contact 42.

Example 14

Figure 6:
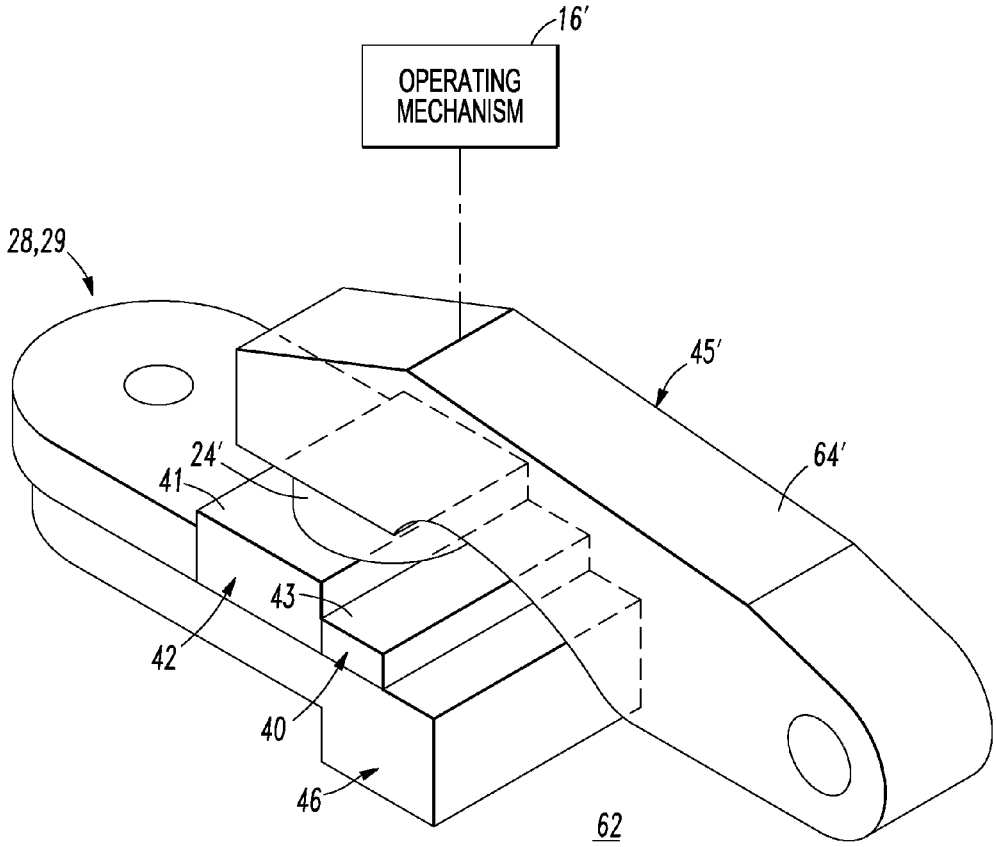
FIG. 6 is a block diagram of a circuit interrupter including the stationary contact assembly of FIG. 3.

The second stationary contact 40 can be structured to cooperate with the first stationary contact 42 in order to extend the endurance life of the stationary contact assembly 28,29, the transfer switch 10 and/or a circuit interrupter (e.g., without limitation, 62 of FIG. 6, such as a circuit breaker, contactor, power contactor or other electrical switching apparatus (not shown)).

Example 15

Referring to FIGS. 3-5, the stationary contact assemblies 28,29 include the second stationary contact 40, the first stationary contact 42, the mounting block 46, the arc runner 48 and the spin rivet 50. The second stationary contact 40 assists the first stationary contact 42 due to the durability characteristics of the second stationary contact 40. After the first stationary contact 42 is mostly worn, the second stationary contact 40 will assist the first stationary contact 42 to extend the endurance life of the example ATS 10 (FIGS. 1 and 2) or circuit interrupter 62 (FIG. 6).

Example 16

The stationary contact assemblies 28,29 of FIG. 2 can be essentially identical, except their positions are inverted by 180 degrees. The same is true of the movable contact assemblies 45. As shown in FIG. 3, the stationary contact assemblies 28,29 include the first stationary contact 42 and the second stationary contact 40. The first and second movable contacts 24 or 26 of FIG. 2 are each disposed on a movable arm 64 of a corresponding movable contact assembly 45. Through repetitive operations, the movable contacts 24 or 26, over time, can wear through the corresponding first stationary contact 42 until the corresponding one of the movable contacts 24 or 26 touches the corresponding second stationary contact 40.

Example 17

The circuit interrupter 62 of FIG. 6 includes a movable contact assembly 45' having a movable contact 24', the stationary contact assembly 28 or 29 (FIG. 3), and an operating mechanism 16' structured to move the movable contact assembly 45' and cause the movable contact 24' to engage or disengage from at least the first contact surface 41 of the first stationary contact 42.

Example 18

The movable contact assembly 45' includes a movable arm 64' carrying the movable contact 24'.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A stationary contact assembly comprising:
a conductor;
a first stationary contact disposed on said conductor; and
a second stationary contact disposed on the same said conductor proximate said first stationary contact,
wherein said first stationary contact has a first contact surface disposed a first distance from said conductor,
wherein said second stationary contact has a second contact surface disposed a second distance from said conductor, and
wherein said second distance is smaller than said first distance wherein the first contact surface of said first stationary contact is subject to wear such that said first distance is subject to being reduced to about said second distance; and wherein after said wear, both of said first and second stationary contacts are structured to be engaged by a movable contact.

2. The stationary contact assembly of claim 1 wherein said first stationary contact is relatively more conductive than said second stationary contact.

3. The stationary contact assembly of claim 1 wherein said second stationary contact is disposed on said conductor adjacent said first stationary contact.

4. The stationary contact assembly of claim 1 wherein said first stationary contact is structured to resist arcing better than said second stationary contact; and wherein said second stationary contact is structured to be more durable than said first stationary contact.

5. The stationary contact assembly of claim 1 wherein said second stationary contact is structured to cooperate with said first stationary contact in order to extend the endurance life of said stationary contact assembly.

6. The stationary contact assembly of claim 1 wherein said first stationary contact includes a first side and an opposite second side; wherein the conductor is a conductive mounting block; wherein an arc runner is disposed on said conductive mounting block adjacent the first side of said first stationary contact; and
wherein said second stationary contact is disposed on said conductive mounting block adjacent the opposite second side of said first stationary contact.

7. A circuit interrupter comprising:
a movable contact assembly comprising a movable contact;
a stationary contact assembly comprising:
a conductor,
a first stationary contact disposed on said conductor, and
a second stationary contact disposed on the same said conductor proximate said first stationary contact,
wherein said first stationary contact has a first contact surface disposed a first distance from said conductor,
wherein said second stationary contact has a second contact surface disposed a second distance from said conductor, and
wherein said second distance is smaller than said first distance; and
an operating mechanism structured to move said movable contact assembly and cause said movable contact to engage or disengage from at least the first contact surface of said first stationary contact wherein said movable contact assembly, over time, causes said movable contact to wear the first contact surface of said first stationary contact until said movable contact engages both of the first and second contact surfaces.

8. The circuit interrupter of claim 7 wherein said circuit interrupter is a power contactor.

9. The circuit interrupter of claim 7 wherein said circuit interrupter is a circuit breaker.

10. The circuit interrupter of claim 7 wherein said movable contact assembly further comprises a movable arm carrying said movable contact.

11. The circuit interrupter of claim 7 wherein said second stationary contact is structured to cooperate with said first stationary contact in order to extend the endurance life of said circuit interrupter.

12. A transfer switch comprising:
two movable contact assemblies, each of said two movable contact assemblies comprising a movable contact;
two stationary contact assemblies, each of said two stationary contact assemblies comprising:
a conductor;
a first stationary contact disposed on said conductor, and
a second stationary contact disposed on the same said conductor proximate said first stationary contact,
wherein said first stationary contact has a first contact surface disposed a first distance from said conductor,
wherein said second stationary contact has a second contact surface disposed a second distance from said conductor, and
wherein said second distance is smaller than said first distance; and
an operating mechanism structured to move said two movable contact assemblies and cause the movable contact of a corresponding one of said two movable contact assemblies to either engage or disengage from at least the first contact surface of said first stationary contact of a corresponding one of said two stationary contact assemblies wherein each of said movable contact assemblies further comprises a movable arm carrying said movable contact; and wherein said movable contact assembly, over time, causes said movable contact to wear the first contact surface of said first stationary contact until said movable contact engages both of the first and second contact surfaces.

13. The transfer switch of claim 12 wherein said transfer switch is an automatic transfer switch.

14. The transfer switch of claim 12 wherein one of said two movable contact assemblies is structured to receive a first power source; wherein the other one of said two movable contact assemblies is structured to receive a second power source; wherein the conductor of one of said two stationary contact assemblies is electrically connected to the conductor of the other one of said two stationary contact assemblies; and wherein said conductors are structured to power a load.

15. The transfer switch of claim 12 wherein said second stationary contact is structured to cooperate with said first stationary contact in order to extend the endurance life of said transfer switch.

16. The transfer switch of claim 12 wherein said first stationary contact includes a first side and an opposite second side; wherein an arc runner is disposed on said conductor adjacent the first side of said first stationary contact; wherein said second stationary contact is disposed on said conductor adjacent the opposite second side of said first stationary contact; wherein the conductor of one of said two stationary contact assemblies is coupled to the conductor of the other one of said two stationary contact assemblies; and wherein said conductors are structured to power a load.

17. The transfer switch of claim 12 wherein said first stationary contact is made of 97% silver and 3% carbon; and wherein said second stationary contact is made of 50% silver and 50% tungsten.

* * * * *